US006704951B2

(12) United States Patent
Hofer et al.

(10) Patent No.: US 6,704,951 B2
(45) Date of Patent: Mar. 16, 2004

(54) CRIB

(75) Inventors: Daniel Hofer, Ulster Park, NY (US); Allister Marchant, Ulster Park, NY (US)

(73) Assignee: Community Products, LLC, Rifton, NY (US)

( * ) Notice: Subject to any disclaimer, the term of this patent is extended or adjusted under 35 U.S.C. 154(b) by 108 days.

(21) Appl. No.: 09/898,189

(22) Filed: Jul. 3, 2001

(65) Prior Publication Data

US 2003/0005520 A1 Jan. 9, 2003

(51) Int. Cl.[7] ..... A47D 7/00
(52) U.S. Cl. ..... 5/100; 5/93.1
(58) Field of Search ..... 5/93.1, 100, 425, 5/429

(56) References Cited

U.S. PATENT DOCUMENTS 3,002,199 A * 10/1961 Galloway ..... 454/321
3,193,849 A * 7/1965 Landry ..... 5/100
3,193,850 A * 7/1965 Landry ..... 5/100

* cited by examiner

*Primary Examiner*—Heather Shackelford
*Assistant Examiner*—Fredrick Conley
(74) *Attorney, Agent, or Firm*—Joseph B. Taphorn

(57) ABSTRACT

Drop side of a child-proof crib has a top portion which can be lowered with respect to its bottom portion. Its top railing is rendered vertically translatable by employing telescoping stiles between it and the bottom railing. Double-action latch mechanisms in the upper railing hold the drop-side upper portion up. The drop-side upper railing has an upper bar fixedly secured upon a lower bar: the lower surface of the upper bar opens to a longitudinally-extending groove slidably receiving rods of the two latches that are biased outwardly from central triggers to beyond the outer ends of the railing to where they each engage on their free ends a shoulder-bearing latch bracket mounted on the opposing face of the associated corner post. Crib mattress platform is adjustable vertically using plunger latch mechanisms whose plungers are withdrawable only by inserting a tool through a narrow slot in the platform.

13 Claims, 10 Drawing Sheets

CRIB

FIELD OF THE INVENTION

This invention relates to a crib or child's bed with high sides of which at least one is adjustable, and with a vertically adjustable mattress platform, and more particularly, to a crib or child's bed wherein an adjustable high side may have its top or upper portion lowered without adjustment of its bottom, and wherein the lowerable top may be secured in place by a child-proof double-action latch mechanism, and wherein the height of the mattress platform may be secured in place with a child-proof latch mechanism.

BACKGROUND OF THE INVENTION

Cribs with vertically adjustable sides to enable convenient servicing of a child in the crib, and with an adjustable raised mattress platform to accommodate children of different ages, are well known. The raised mattress platform provides storage space beneath the crib. Usually the whole adjustable side, formed with top and bottom railings interconnected with stiles or other barriers, translates vertically, with the result that in the lowered position permitting ready access to the child, access to the storage place below the raised mattress platform is blocked and precludes reaching articles commonly used during when the drop side is lowered.

Community Playthings, doing business of Community Products, LLC, already markets a crib "WAS G10 Small Crib". It has two end panels each constituted alternatively of either clear plastic or wooden stiles mounted at its side edges in crib corner posts. Respective ones of the end panel posts are pivotally interconnected by side panels having appropriately-spaced wooden stiles between upper and lower railings. The bottom railings are a distance above the room floor, permitting the storage of baby materials below the crib. A mattress support is adjustably mounted in the crib between the side panels.

The pivotal interconnections of the end panels with the side panels enable sidewise collapse of the crib upon itself (after removal of the mattress support, and of course the mattress), and are achieved by pivotally mounting the ends of the railings in delrin plastic cups having upper and lower leaves formed internally of the cup with facing embossments co-acting with recesses formed in the upper and lower sides of each railing end, the ends of the leaves being urged together spring-like. The spring-like leaves also permit ready assembly and disassembly of the crib by enabling forceful insertion and removal of the railing ends therein. The present crib does not have a drop side.

PRIOR ART

Patents showing cribs with vertically translatable sides include U.S. Pat. No. 3,934,282 issued Jan. 27, 1976 to Bryant; U.S. Pat. No. 4,706,312 issued Nov. 17, 1987 to Shamie; U.S. Pat. No. 4,924,539 issued May 15, 1990 to Benoit; and U.S. Pat. No. 6,167,580 issued Jan. 2, 2001 to Draheim et al. In Bryant, the vertically translatable side slides on rods mounted on crib end posts. In Shamie, elements on the drop side extend into vertical slots in the crib end posts. In Benoit, special drop side guides and a double action device are built in and operate the slidable-up and -down drop side according to regulations. In Draheim et al, the vertically translatable drop side is secured to opposing pairs of tracks.

Recent patents showing cribs with high sides include the aforementioned U.S. Pat. No. 4,924,539 issued May 15, 1990 to Benoit; U.S. Pat. No. 4,226,452 issued Oct. 7, 1980 to Hoffman et al; U.S. Pat. No. 4,535,493 issued Aug. 20, 1985 to Guillot; and U.S. Pat. No. 5,072,464 issued Dec. 17, 1991 to Draheim et al.

Recent patents showing cribs with adjustable mattress platforms include U.S. Pat. No. 4,825,482 issued May 2, 1989 to Paris; U.S. Pat. No. 5,155,880 issued Oct. 20,1992 to Schoonover et al; and U.S. Pat. No. 5,214,808 issued Jun. 1, 1993 to Schoonover et al.

SUMMARY OF THE INVENTION

Accordingly, it is an object of the invention to improve care for infants by facilitating access to the bottom of the Community Playthings crib "WAS G10 Small Crib" by their caregivers.

A particular object of the invention is to enhance gently easing a sleeping infant into the Community Playthings crib "WAS G10 Small Crib", by the ability to temporarily reduce the reach necessitated by the operation.

A specific object of the invention to provide the Community Playthings crib "WAS G10 Small Crib" with a drop side.

Another object of the invention is to provide a crib wherein the storage space beneath a drop-side crib remains accessible while a child in the crib is being conveniently serviced therein.

Still another object of the invention is to provide a crib drop side which can not be lowered by a child inadvertently or intentionally.

A further object of the invention is to provide a crib drop side which can be easily lowered by the free hand of the mother holding the child with the arm of the other hand.

Another object of the invention is to provide a drop-side crib which is collapsible sideways upon itself for storage after removable of the mattress support.

A further object of the invention is to provide a crib having a removable mattress support with protection against inadvertent or intentional dislocation by a child.

A related object of the invention is the provision of a mattress support latch that cannot be operated by a child.

An object of the invention is to provide such a crib that complies with all safety regulations of the United States and the United Kingdom Still another object of the invention is to provide such a crib which is easy to use.

Yet another object of the invention is to provide a drop-side crib which is still easy to assemble and disassemble.

A further object of the invention is to provide a drop-side crib which is still simple of construction and easy and inexpensive of manufacture.

The objects of the invention are achieved by providing the drop side of a crib with a top or upper portion which can be lowered with respect to its bottom portion Specifically, the top railing of the drop side is vertically translatable with respect to the bottom railing which is operationally fixed with respect to the crib. Vertical translation of the drop-side top or upper railing is accomplished by employing stiles having telescoping sections between the drop-side top and bottom railings: when the top railing is unlatched, the telescoping sections attached to it slide down in or on their complementary sections affixed to the bottom rail to rest thereon; when the top railing is raised again to its latching position, the telescoping rod sections attached to it slide up in or on their complementary sections affixed to the bottom rail to form the drop side constituting a full barrier to a child on the mattress support in the crib. In the preferred embodiment, a hollow cylindrical telescoping section is affixed at its upper end to the drop side upper railing, whereas the complementary rod or interior telescoping section is affixed at its lower end to the lower railing.

A feature of the invention is that the rod or interior or lower telescoping sections of the stiles are formed of wood encased in plastic. This prevents the expansion of the wood from the absorption of moisture and hence minimizes the danger of the telescoping sections binding; this in turn enables a closer fit between the telescoping sections of the respective stiles in order to eliminate a child's exposure to any pinching by the relatively movable sections of a stile.

The drop side is secured in a vertical disposition and guided in its movements between raised and lowered positions by latch brackets mounted on the faces of the end-panel corner posts facing it, and by slides pivotally mounted on, the top-railing adjacent ends. The brackets extend vertically along the posts and have sidewise projections which are embraced by complementary grooves in the outer face of the slides. Thus the upper railing cannot be pulled inward or pushed outward by a child.

The drop side is rendered safe against operation by a child by employing double-action latch mechanisms. Two double-action latch mechanisms are used: one for each end of the drop side to latch it to the end-panel corner post adjacent that end. The two latch mechanisms are mounted in the upper railing. To this end, the drop-side upper railing is provided with an upper bar fixedly secured to a lower bar: the lower surface of the upper bar is provided with a longitudinally-extending groove slidably receiving rods of the two latch mechanisms that are biased outwardly from central triggers and extend beyond the outer ends of the railing to where they each engage on their free ends a shoulder-bearing latch bracket mounted on the opposing face of the associated corner post of the end panel; the upper surface of the lower bar retains the latch rods in the upper-bar groove. The upper bar reacts against the latch rods to support the drop-side top or upper portion in raised position when the free ends of the latch rods rest on top of their associated latch bracket shoulders. The two triggers extend downward from the inner free ends of the two latch rods through slots of length in the lower bar accommodating operational movement thereof, and are biased apart by a compression spring which thus also biases the latch rods outward to where they engage the latch brackets.

Movement of the two triggers inward (toward each other and against the spring bias), withdraws the free ends of the latch rods from over the associated corner-post latch-bracket shoulders to allow the drop-side top or upper portion to descend until the upper ends of the rods of the telescoping stiles are slid down upon by the associated tubes to where they engage the bottom surface of the upper-railing lower bar. The free ends of the latch rods and the latch brackets (of sufficient length) are formed of materials (e.g. delrin) facilitating free sliding contact with each other, thus enabling the triggers to be released after the initial unlatching and some beginning of the downward movement of the railing of the drop-side top or upper portion.

The latch mechanisms are rendered double action ones by forming the free ends of the latch bars wider, and by enlarging the width of the outer ends of the longitudinally-extending upper bar groove in two stages. In the first or outer stage, the grooves at each end are enlarged to their full heights for a short length, allowing the bar wider free-ends to be fully received therein under the upper-bar reflected weight of the drop-side upper portion when the free ends rest on top of the bracket shoulders, but restricting inward movement of the latch rods and hence preventing unlatching. In the second or inner stage, only the lower area of the groove is widened to accommodate withdrawal of the free ends of the latch rods when they are in their lower position in the groove due to sprig action and the drop-side having been lifted to take the its weight off of the latch rods. The weight of the drop-side top portion is such as to compress the first stage springs and allow the upper bar to descend upon the latch rod as the latch-rod wider free end portions enter the first stage wider portion of the groove. Withdrawal of the latch rod free ends by squeezing of the triggers together is thus prevented by the engagement of the enlarged free ends with the shoulders at the inner end of the first stage. However first lifting of the upper drop-side portion allows 1) the first stage springs to push the wider free end portions downward to where they are no longer aligned with the first stage shoulders, and 2) the operation of the triggers to withdraw the free ends into the second stage, whereupon the bar free ends clear the bar shoulders and the drop-side upper portion can be lowered Thus the drop side can only be lowered by first raising it.

A feature of the invention is that a mother holding a baby in one arm, can lower the drop side by grasping the triggers with the fore and index finger of the other arm hand to first raise the upper portion of the drop side and then squeezing the triggers together and momentarily holding them so until the free ends of the latch rods clear the top of the latch bracket shoulders during the downward translation.

Another feature of the invention is that pressure of the free ends of the latch rods on the latch brackets is minimized to reduce friction and thus facilitate up and down motion of the drop side top portion This allows stronger biases to be applied against trigger displacement to render the crib more child proof To raise the drop-side top or upper portion and latch it in raised position, the top portion need merely be raised substantially evenly until the free ends of the latch rods pass over the latch bracket shoulders, the bottom of the latch shoulders being cammed to force the latch rod free ends inward as they approach the shoulders.

The mattress platform or bottom or floor of a crib is adjustable to different vertical positions. Adjustment of the mattress platform by a child is prevented by a unique latch arrangement. A plunger latch mechanism is mounted on the underside of each corner of the platform; but the plunger may be withdrawn to unlatching position only by inserting a tool through a narrow slot in the mattress platform. To this end, a slidable block in the latch mechanism and attached to the plunger is engageable through the narrow slot by a tool such as a key or pen to displace it to where the plunger is withdrawn from a recess in the corresponding corner post.

If the latch mechanism along one side edge of the mattress platform are operated and the mattress platform removed from the crib by raising that edge and pulling the plungers on the other edge from their recesses in their corner posts, this crib too can be collapsed onto itself. Pivotal action of the drop-side panel with respect to the end panels is enabled by the aforementioned pivotal mounting of the slides on the upper railing. The drop side lower railing is mounted on the end panel by the aforementioned delrin plastic cups having upper and lower leaves formed internally of the cup with facing embossments co-acting with recesses formed in the upper and lower sides of the other railing ends.

BRIEF DESCRIPTION OF THE DRAWINGS

These and other objects, features, and advantages of the invention will become apparent from a reading of the following description of a preferred embodiment of the invention when considered with the accompanying drawings wherein.

DETAILED DESCRIPTION OF A PREFERRED EMBODIMENT OF THE INVENTION

Figure 1:
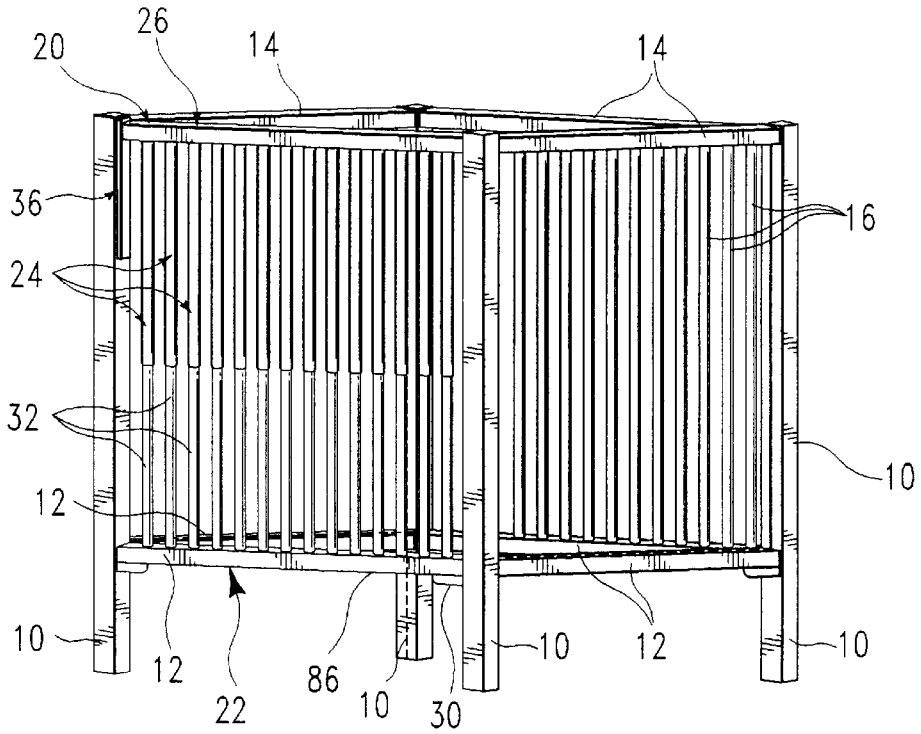
FIG. 1 is a view in perspective of a crib showing the drop side of the crib with its upper portion in its raised position.
Figure 2:
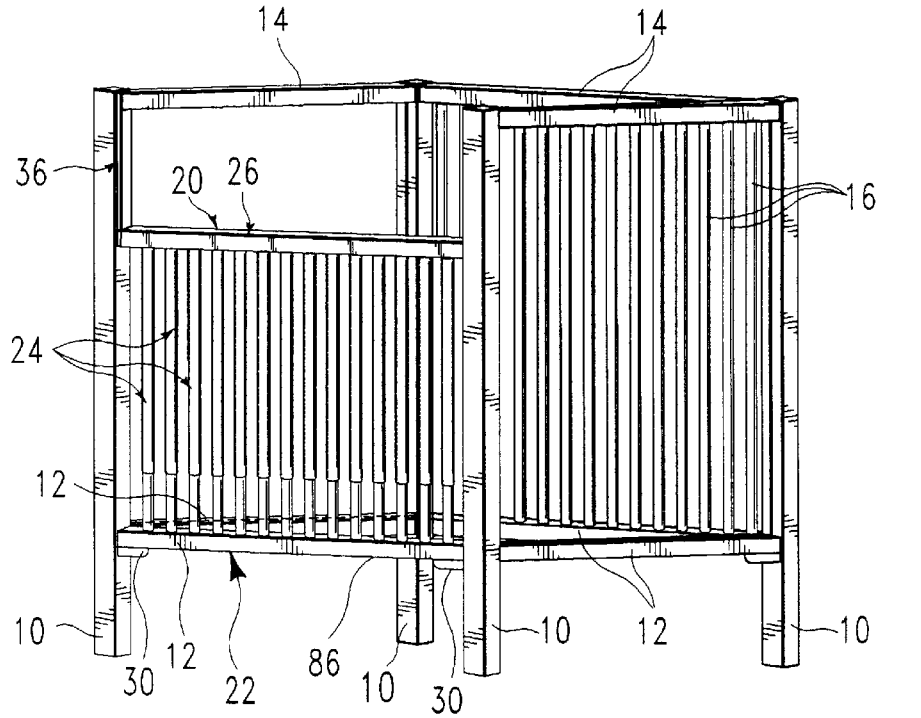
FIG. 2 is the same view in perspective of a crib but showing the upper portion of the drop side of the crib in its lowered position.

Referring now more particularly to the drawings, there is shown in FIGS. 1 and 2 a crib constructed according to the invention. The crib includes four corner posts 10; four lower rigid railings 12; and three rigid upper railings 14. Sets of two corner posts 10 are rigidly joined to sets of upper and lower rigid railings 14 and 12 to define rigid end panels which mount a glass such as plexiglass, or alternatively wooden stiles, therebetween to provide a suitable yet-see-through barrier to protect a child.

The end panels are interconnected by side panels: one being a relatively fixed panel; the other being the drop side. The back side panel employs conventional stiles 16, suitably spaced to contain a child within the crib; they extend vertically between corresponding lower and upper railings 12 and 14. (The stiles 16, for the most part, are shown through the glass of the right hand end panel of FIGS. 1 and 2.) The back side panel is pivotally mounted, in conventional Community Playthings crib construction, via the ends of its railings 12 and 14 in delrin plastic cups having upper and lower leaves formed internally of the cup with facing embossments co-acting with recesses formed in the upper and lower sides of each railing end, the ends of the leaves being urged together spring-like; the pivotal mounting facilitating collapse of the crib upon itself. The spring-like leaves also permit ready assembly and disassembly of the crib by enabling forceful insertion and removal of the railing ends therein. A floor or mattress support 86 provides rectangular rigidity to the crib; rigidity of the crib before mounting the floor is somewhat obtained by suitably detenting the spring-like leaves and associated railing ends.

The front panel of the crib is the drop side. In FIG. 2 the drop side is shown in lowered position, and in FIG. 1 in raised position. The drop side has a vertically-translatable upper portion generally indicated by the numeral 20, and a fixed lower portion generally indicated by the numeral 22 and which includes the front lower railing 12 similar to the lower railing 12 of the back side panel. Telescoping stiles, generally indicated by the number 24 and suitably spaced, interconnect the upper railing generally indicted by the numeral 26 of the drop-side vertically-translatable upper portion 20, with railing 12 of the fixed lower portion 22.

Figure 3:
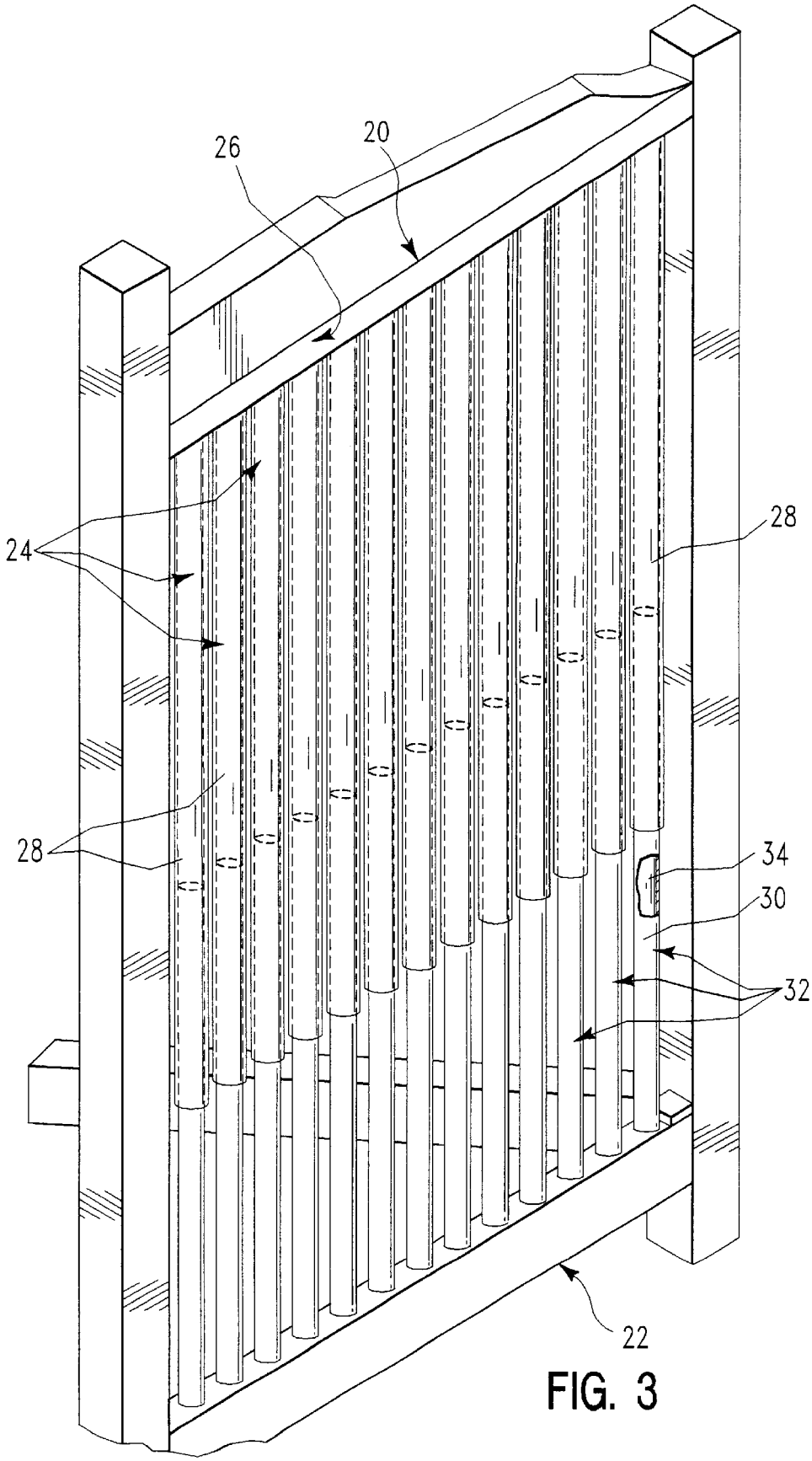
FIG. 3 is an enlarged view in perspective of a portion of the crib showing its drop side with its upper portion raised and its stiles in greater detail.

As best seen in FIG. 3, the telescoping stiles 24 are each partially formed of a tube 28 affixed as by nailing at its upper end in a recess in the bottom of a railing 26 of the vertically-translatable drop-side upper portion 20; the tubes are formed of a suitable wear-resistant plastic having a low coefficient of friction such as polyvinyl chloride (PVC). The telescoping stiles 24 are also each partially formed of a rod generally indicated by the numeral 32 affixed at its lower end as by nailing in a recess in the top of the railing 12 of the drop-side fixed lower portion 22. Contrary to the hollow tubs 28, each of the rods 32 is formed of an inner wooden dowel 34 (see the right-hand stile in FIG. 3) and an outer plastic tube 30 of a diameter that permits the rod 32 to be slidably received within the corresponding plastic upper tube 28. The wooden dowel adds strength and rigidity to the bottom portion of a stile 24, while its plastic tube 30 protects it from moisture and consequent swelling which would bind the rod 32 within the tube 28. Thus the drop-side translatable upper portion 20 may always be made to slide down upon the telescoping tubes towards the drop-side fixed lower portion 22 and up to its raised or safety position.

Not only is the drop-side upper portion 20 guided in its up and down movements by the telescoping stiles 24, hut also by a slide (FIGS. 6, 10, 12, and 13), generally indicated by the numeral 38, on each end of the top railing 26; and by a latch bracket (FIGS. 1, 2, 6, and 12–15) generally indicated by the numeral 36 and secured on the opposing faces of the adjacent end-panel corner posts 10 of the crib (FIGS. 1–3). Thus the drop side is secured in a vertical disposition and firmly guided in its movements between raised and lowered positions by latch brackets 36 mounted as by screws on the surfaces of the end-panel corner posts 10 facing it, and the complementary slides 38 pivotally mounting the top railing 26 adjacent ends. A slide 38 is pivotally mounted on its end on the top of the upper railing 26 via a rotatable tubular lug 39 depending from a laterally extending flange and received in a complementary opening in the adjacent end of the top railing 26 to which it is suitably bolted.

A latch bracket 36 extends vertically along its post 10 and has sidewise projections 40 which are embraced by complementary grooves 42 in the outer face of a vertically-extending portion of the slide 38. Thus the upper railing cannot be pulled inward or pushed outward by a child.

A ridge 44 in the center of the upper end of the outside face of the latch bracket 36 cooperates with a groove 46 in center of the outer face of the slide 38 to provide additional resistance to sidewise, displacement of the drop-side upper portion 20 when it is in its raised position where maximum leverage would obtain. Upward excursion of a slide 38 on its bracket 36, as during lifting of the drop-side upper portion 20 to enable unlatching it, is limited by engagement of shoulders 41 (FIG. 13) in the slide 38 against the stop 35 at the top end of the bracket 36.

Figure 4:
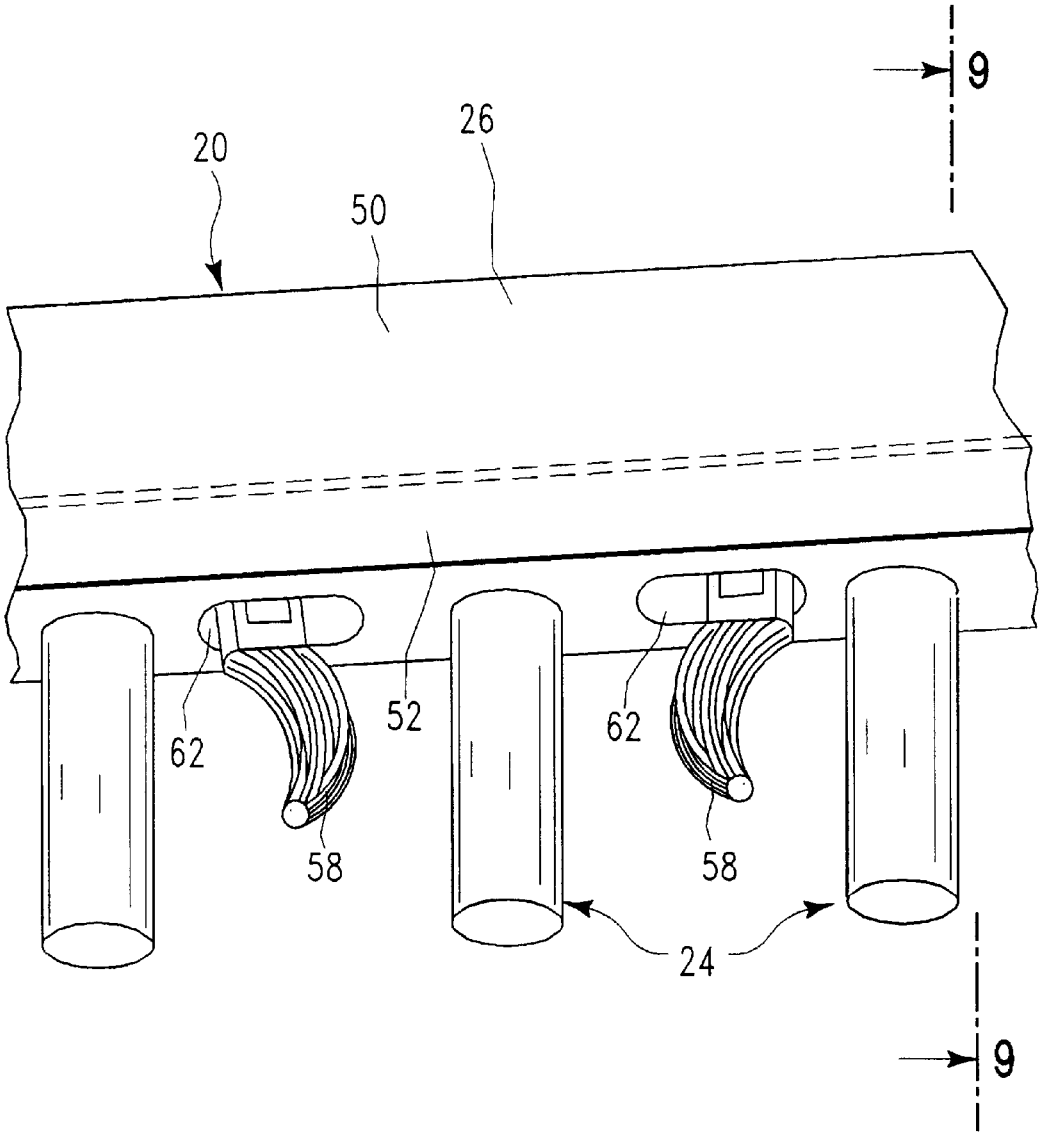
FIG. 4 is an enlarged view in perspective of the central part of the upper portion of the drop side showing the drop side two-part top railing and the two triggers protruding from slots in the underside of the bottom part and which must be squeezed together to unlatch the railing for lowering.
Figure 5:
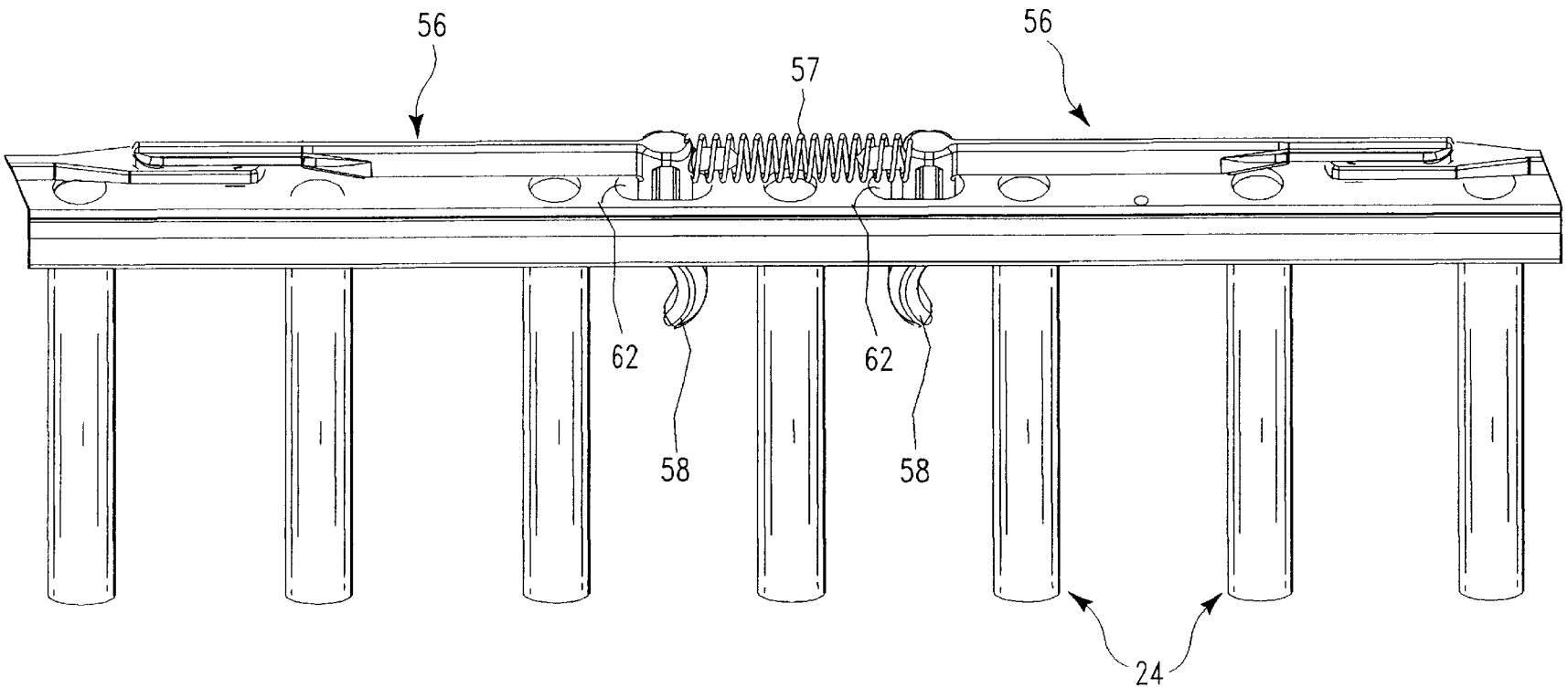
FIG. 5 is a view in perspective of the central part of the upper portion of the drop side, showing the top railing with its upper part removed to leave behind and show the latching mechanism for securing the drop-side upper portion in raised position.
Figure 6:
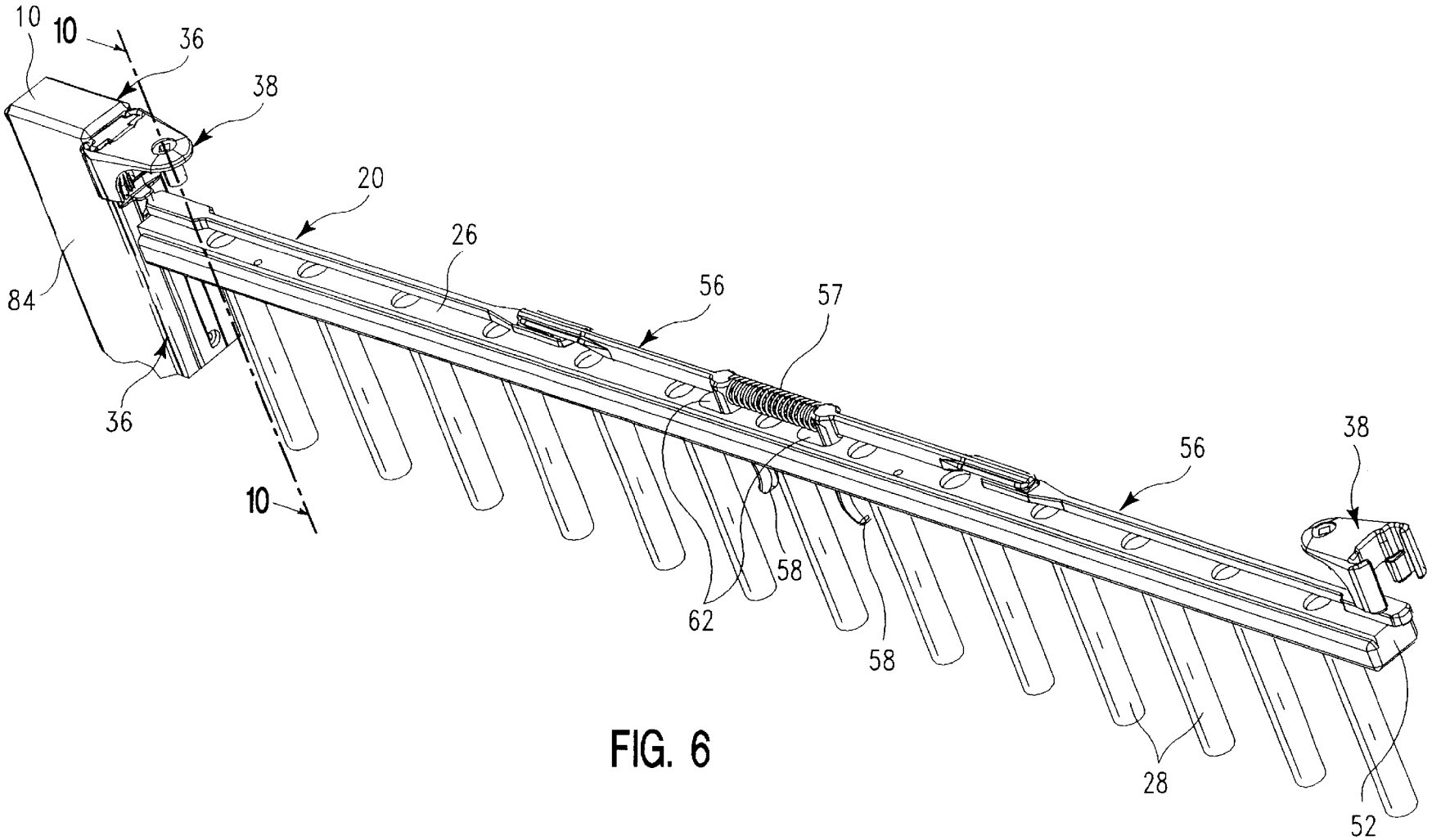
FIG. 6 is an enlarged view in perspective of piece of the upper portion of the drop side, showing the upper part of top railing uncovered to leave behind and expose the associated latching mechanism for securing the upper portion in raised position on the latch bracket of the nearby corner post.

The drop-side upper portion 20 is rendered safe against lowering by a child by incorporating double-action latch mechanisms in its upper railing 26. Two double-action latch mechanisms are used: one for each end of the drop-side upper portion 20 to latch it securely to the end-panel corner post adjacent that end. The two latch mechanisms are mounted within the upper railing 26. To this end, the upper railing 26 is provided with an upper bar 50 (FIGS. 4 and 9–11) fixedly secured as by screws upon a lower bar 52: the lower surface of the upper bar 50 being provided with a longitudinally-extending groove 54 slidably receiving latch rods generally indicated by the numeral 56 of the two latch mechanisms and that are biased outwardly from centrally located triggers 58 secured to the inner ends of rods 56, by a compression spring 57 (FIGS. 5 and 6) interposed between them, to beyond the outer ends of the railing 26 to where they can each engage on their free ends the upper side of a shoulder 60 (FIGS. 12, 14 and 15) on the associated latch bracket 36 mounted on the opposing face of the adjacent corner post 10 of an end panel; the upper surface of the lower bar 52 retains the latch rods 56 in the upper-bar groove 54. The upper bar 50 reacts against the latch rods 56 to support the drop-side top portion 20 in raised position when the free ends of the latch rods 56 rest on top of their associated latch bracket shoulders 60. The two triggers 58 extend downward from the inner ends of the two latch rods 56 through slots 62 (FIG. 4) of a length in the lower bar 52 sufficient to accommodate operational movement thereof; as noted above, they are biased apart by the compression spring 57 which thus also biases the latch rods 56 outward to where they engage the latch brackets 36.

Figure 7:
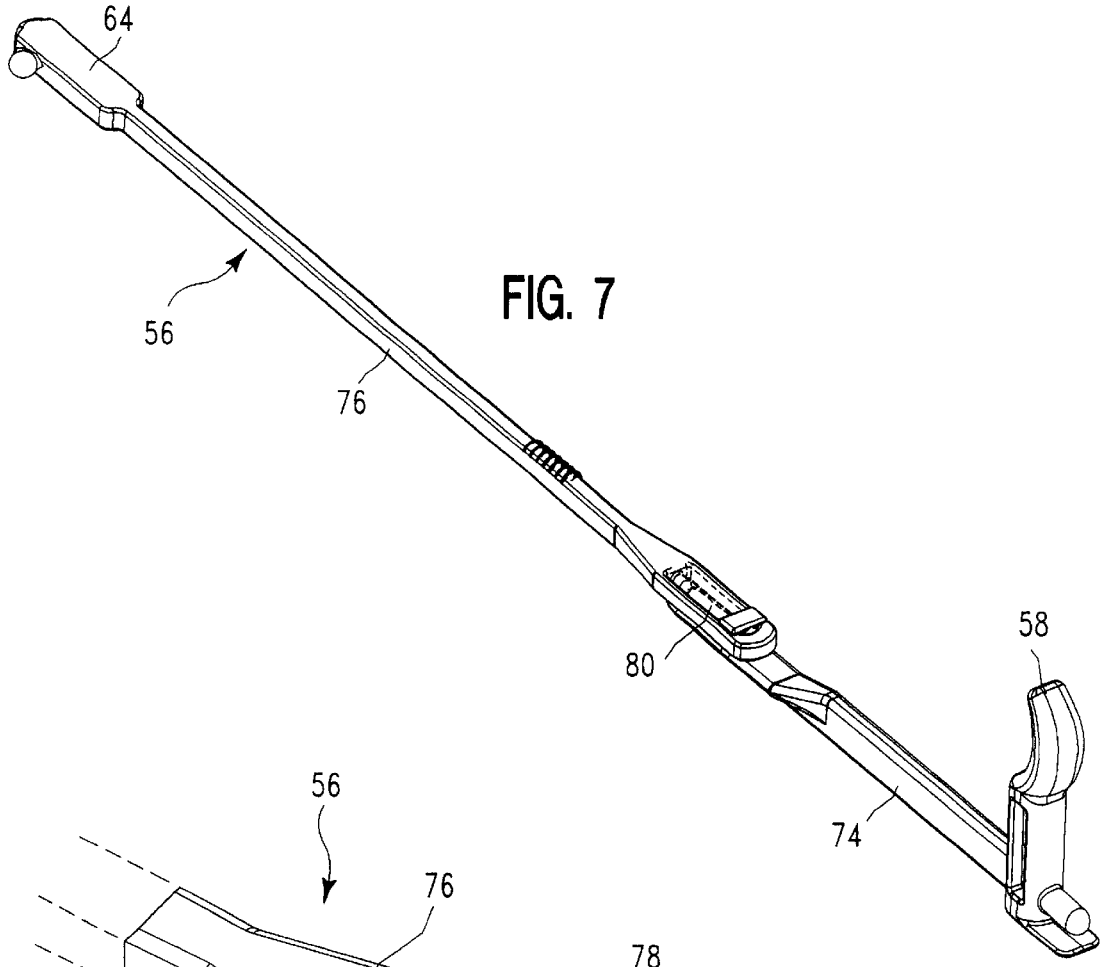
FIG. 7 is an enlarged up-side-down view in perspective of the latching mechanism shown in FIG. 6.

Movement of the two triggers 58 inward (toward each other and against the bias of spring 57), withdraws the free ends 64 (FIGS. 7, 10 and 11) of the latch rods 56 from over the associated corner-post latch-bracket shoulders 60 to allow the drop-side top portion 20 to descend until the upper ends of the rods 32 of the stiles 24 are slid-down upon by the associated tubes 28 to where they engage the bottom surface of the upper-railing lower bar 52. The free ends 64 of the latch rods 56 and the latch brackets 36 (of sufficient length to accommodate the range of translation movement of the upper portion 20) are formed of delrin, a material facilitating free sliding contact with each other, and enabling the triggers 58 to be released after the initial unlatching and some beginning of the downward movement of the top railing 26.

The latch mechanisms are rendered double-action ones first requiring raising of the top railing 26, by forming the free ends 64 of the latch bars 56 wider and by enlarging the width of the outer ends of the longitudinally-extending upper bar groove in two stages. In the first or outer stage, the grooves 54 at each end are enlarged to their full heights as at 66 (FIG. 10) (at least twice the thickness of the bar free ends 64), allowing the bar wider free-ends 64 to be fully received (by rising) therein when the free ends rest on top of the latch bracket shoulders 60. The upper area of the outer or first stage portion 66 of a groove 54 is not of a length to allow withdrawal of the wider free end 64 of the latch bar 56 therein when the trigger 58 is pulled.

However in the second or inner stage, the grooves 54 in the upper bar 50 at the end of the first or outer stages are too widened at their bottom to heights slightly higher than the thickness of the bar wider free ends 64, as at 68 (FIG. 11), to permit withdrawal (and hence unlatching) of the free ends 64 of the latch rods 56 from above the corner-post latch-bracket shoulders 60 when the drop-side-upper portion railing 26 is raised A first-stage spring 72 (FIG. 10) biases each of the free ends 64 of the latch rods 56 downward to a position in which it rests upon the drop-side upper-portion railing lower part 52 and in alignment with the wider groove area 68 and can be moved inward upon operation of its trigger 58. When the free ends 64 of the latch rods 56 rest on the latch bracket shoulders 60, the weight of the drop-side top portion 20 is such as to compress the first stage springs and allow the upper bar 50 to descend upon the latch rod 56 as the latch-rod wider free end portions 64 enter the full-height first-stage wider portion 66 of the groove 54. Withdrawal of the latch rod free ends by squeezing of the triggers together is then prevented by the limited length of the first stage wider groove. Lifting of the railing 26 of the upper drop-side portion 20 allows 1) the first stage springs 72 to push the wider free end portions 64 downward to where they are no longer limited by the shortness of the first stage wider groove, and 2) operation of the triggers 58 to withdraw the wider portions 64 into the second stage longer wider groove wherein the free end portions 64 clear the latch bracket shoulders 60 and the upper drop-side upper portion 20 can be allowed to lower. Thus the drop-side portion 20 can only be lowered by first raising it, and then operating the triggers 58.

It will be evident that a mother can lower the drop-side upper portion 20 while holding a baby in one arm, by grasping the triggers 58 with the fingers such as the thumb and index ones of the hand of the other arm to first push upwards against the railing 26 to raise the upper portion 20 of the drop side and then squeezing the triggers together and momentarily holding them so until the free ends 64 of the latch rods 56 clear the latch-bracket shoulders 60 during the downward translation under the influence of gravity.

Figure 8:
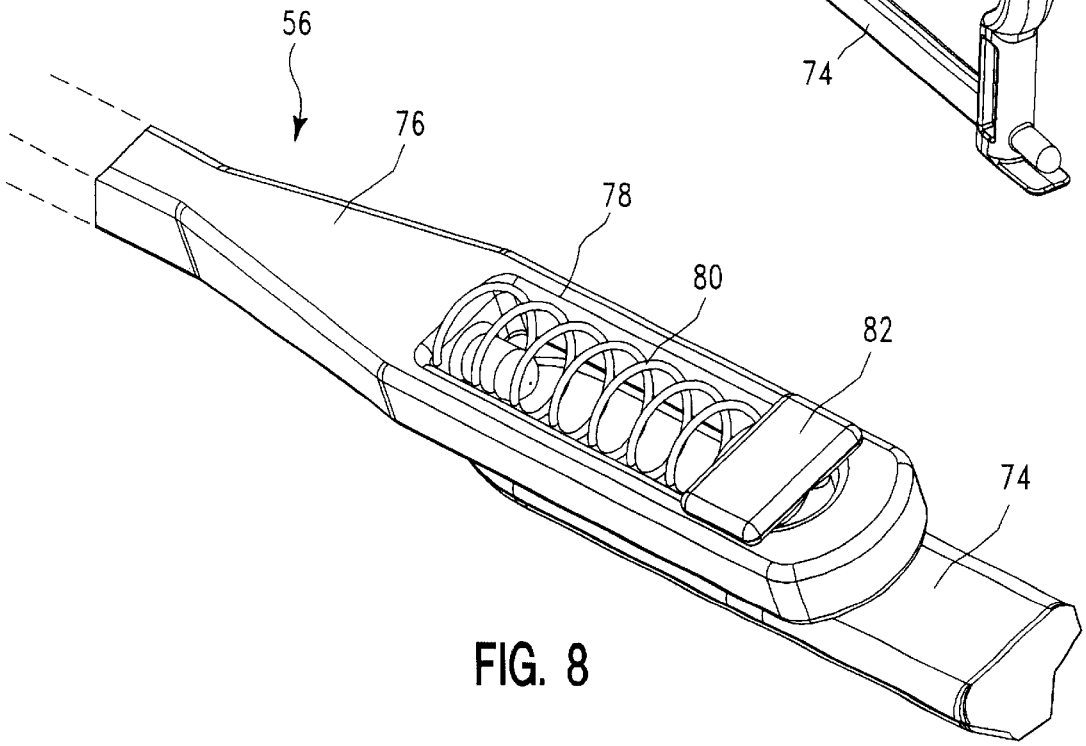
FIG. 8 is an enlarged view in perspective of an intermediate portion of the latching mechanism showing a force reducing connection therein.
Figure 9:
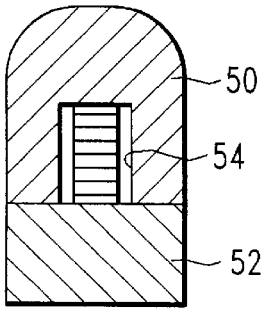
FIG. 9 is an orthogonal vertical cross-sectional view taken of the drop-side top railing taken along the line 9—9 of FIG. 4.
Figure 10:
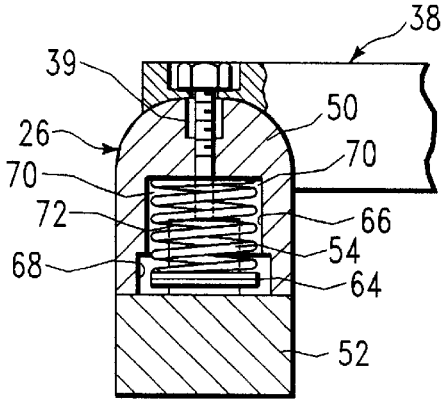
FIG. 10 is an orthogonal vertical cross-sectional view of the drop-side top railing taken along the line 10—10 of FIG. 6 and through the first stage, after it has been lifted for lowering, and showing the slide after it has been rotated 90 degrees.
Figure 11:
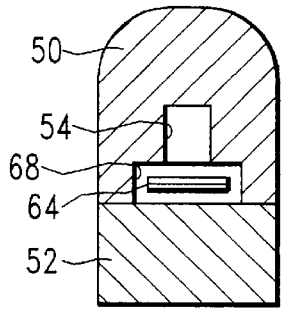
FIG. 11 is an orthogonal vertical cross-sectional view of the drop-side top railing taken on a line just inward of the line 10—10 of FIG. 6 and through the second stage.
Figure 14:
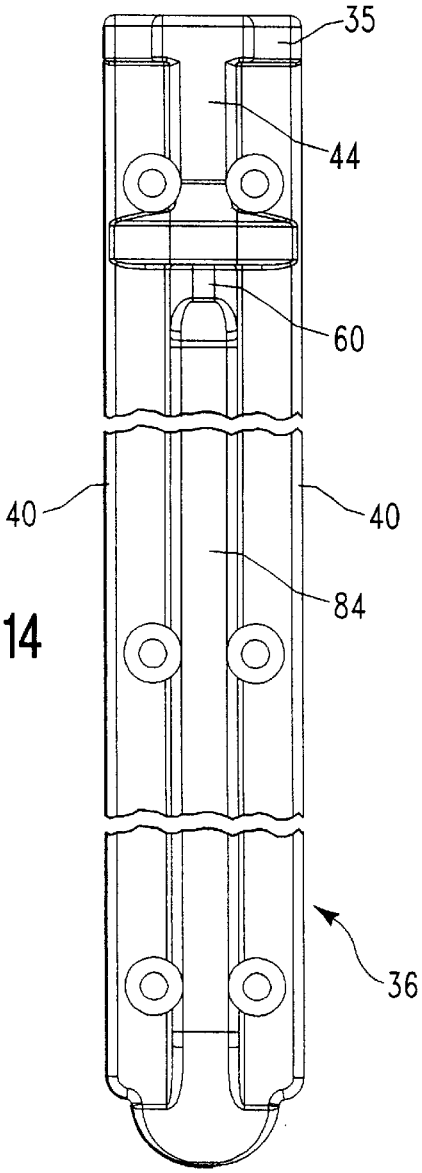
FIG. 14 is an orthogonal vertical front view of the latch bracket of FIG. 13, with the slide removed.
Figure 15:
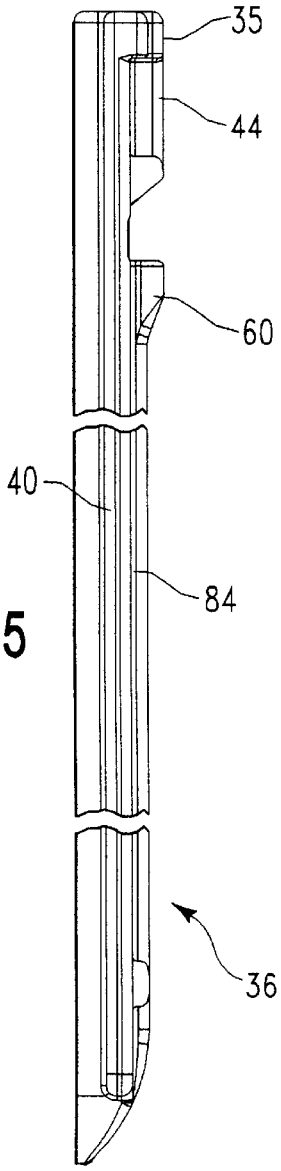
FIG. 15 is an orthogonal vertical view of a side of the latch bracket shown in FIG. 14.
Figure 12:
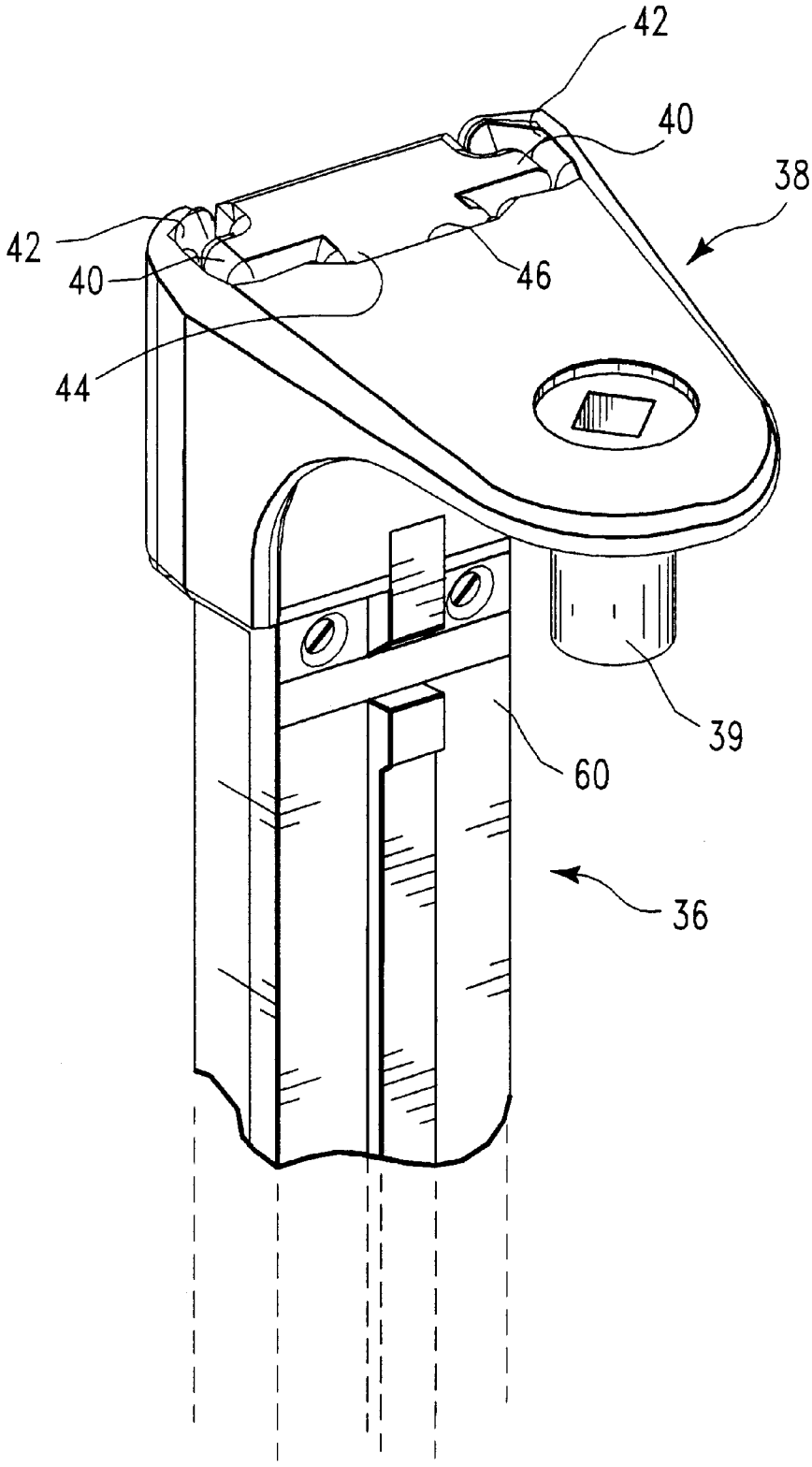
FIG. 12 is a view in perspective of the slide disposed on the upper end of the latch bracket.
Figure 13:
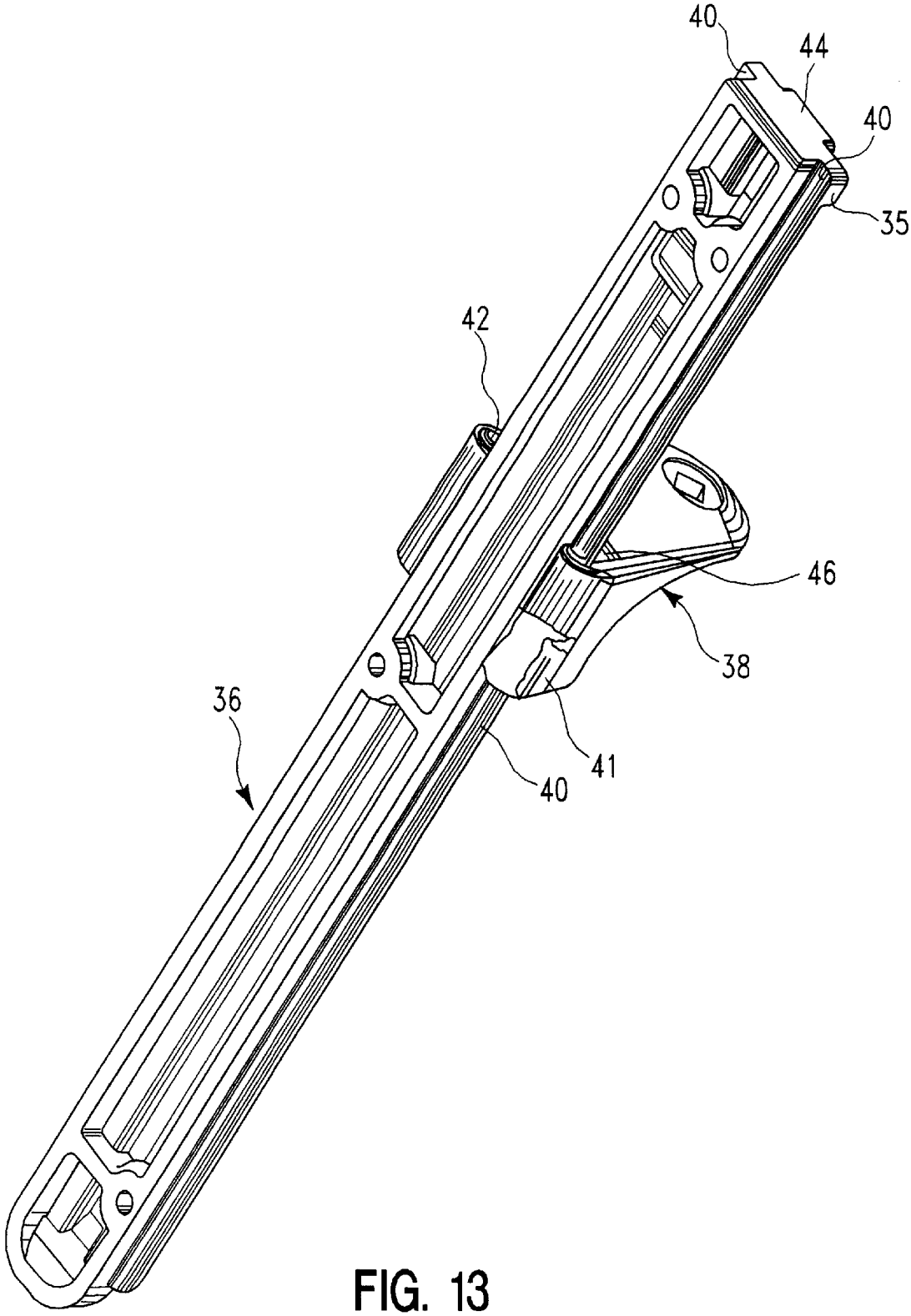
FIG. 13 is a view in perspective of the back side (side mounted on the corner post) of the latch bracket, and showing the slide disposed in a partly lowered position.

Pressure of the free ends 64 of the latch rods 56 on the latch brackets 36 is minimized to reduce friction and thus facilitate up and down motion of the drop-side top portion 20. To this end the latch rod 56 is made in two relatively-movable interconnected parts, an inner part 74 secured to a trigger 58 on its inner end and an outer part 76 having the free end 64 on its outer end, and a relatively weak compression spring 80 (FIGS. 5–8) biasing the latch rod 56 to maximum length. The interconnection details (FIG. 8) involve widening the inner end of the outer rod part 76 sufficient to allow for an elongated inner opening 78 of a width sufficient to accommodate a T-shaped structure 82, depending crosswise from the raised outer end of the inner part 74, to be inserted therein when the parts 74 and 76 are held crosswise. The parts are then arranged rectilinearly and the compression spring 80 inserted between the T-shaped structure 82 and the end of the elongated opening 78 nearest the bar free end 64 to push the free end of the bar 76 outward to the maximum extent permitted by the length of the elongated opening 78. Thus this spring 80 determines the pressure applied by the free end 64 of a latch rod 56 against the glide 84 (FIGS. 14 and 15) on the face of the latch bracket 36. This allows stronger biases to be applied by the compression spring 57 against trigger 58 displacement and render the crib more child proof To raise the top portion and latch it in raised position, the top portion 20 need merely be grasped as by its railing 26 so as to raise it substantially evenly until the free ends 64 of the latch bars 56 pass over the latch bracket shoulders 60, the bottoms of the latch shoulders being sloped to cam the latch rod free ends 64 inward as they approach the shoulders to permit their movement there past.

Figure 16:
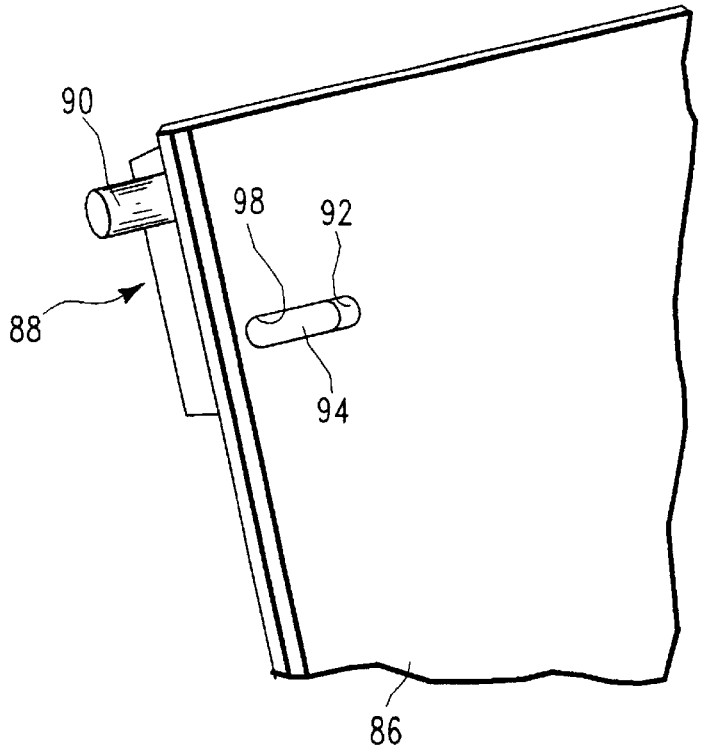
FIG. 16 is a top view in perspective of one of the four corners of the adjustable and removable floor or mattress support of the crib, mounting on its underside a safety latch for interacting with the associated crib corner post.
Figure 17:
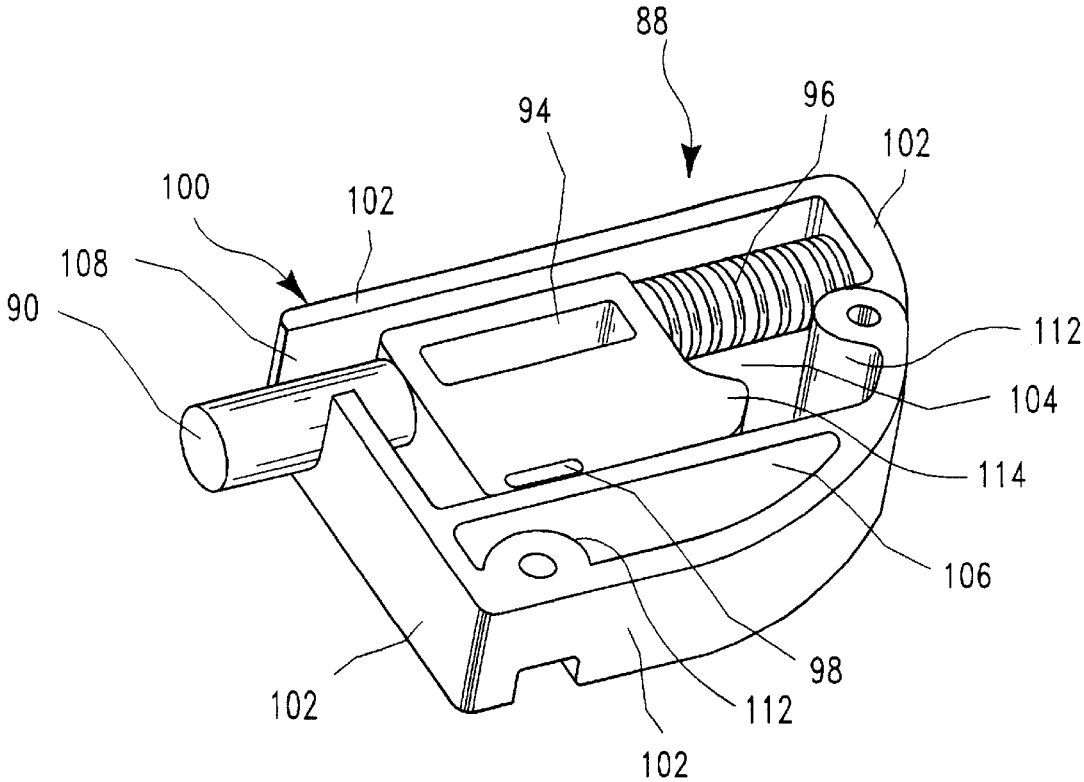
FIG. 17 is a top view in perspective of the safety latch of FIG. 12, unmounted.

The mattress platform or bottom or floor 86 (FIGS. 1, 2, and 16) of a crib is adjustable to different level vertical positions. Adjustment of the mattress platform involves using a special latching arrangement. In the special latching arrangement, four plunger latch mechanisms, such as the one generally indicated by the number 88 (FIG. 16), are mounted respectively on the underside of four corners of the platform 86; furthermore they are mounted so that the plungers 90 of the two latch mechanisms along a side of the crib each extend in the same direction to engage recesses in the corner posts 10 on that side, whereas the plungers 90 of the two latch mechanisms along the other side each extend in the opposite direction to engage recesses in the corner posts 10 on that side.

A plunger 90 may be withdrawn to unlatching position only by inserting a tool such as a key or screwdriver through a narrow slot 92 in the related corner of the mattress platform 86. Each latch mechanism 88 includes a slidable block 94 to which the plunger is secured and a compression spring 96 for biasing the sliding block 92 towards one end of the latch mechanism in which the plunger 90 extends thereout the maximum. The sliding block too contains a slot 98, which in the range of movement of the block, is continuously in line with the mattress support slot 92. Thus the sliding-block slot 98 can be engaged by a tool inserted through the mattress-support slot 92 to move the block 94 inward to remove the plunger 90 from an associated recess in the nearby corner post 10; when the second plunger extending in the same direction is withdrawn in the same manner from its corner post, the interconnecting edge of the mattress platform 86 can be raised somewhat and then the whole mattress platform 86 raised to remove the opposite-direction-extending plungers 90 on the other side, from their corner posts 10. The latter plungers may now be inserted in a new set of the corner-post recesses at a desired mattress-support height and then the opposite edge of the mattress support lowered to the corresponding height recesses on the opposite posts, the plungers moving inward under the camming action of the posts 10.

More specifically the child-proof mattress-support latch mechanism comprises a generally rectangular housing formed of a suitable wear-resistant plastic having a low coefficient of friction such as polyvinyl chloride (PVC) and generally indicated by the numeral 100 and having side walls which meet in a square corner to fit precisely under the square corner of the mattress platform 86; its opposite corner is rounded to save on materials and weight. The bottom of the housing is closed by a floor 104; the top is open and mounted as by screws against the underside of the mattress platform 86. An inner wall 106 is parallel to one of the walls defining the square corner and extends in the general direction of the plunger 90 to define an area for slidably accommodating the block 94 to move parallel to it. The block 94 rigidly mounts the plunger 90 which projects out of the other square-corner wall 102 through a slot 108 formed therein. The compression spring 96 is seated behind the slidable block 94 and reacts against the end wall 102 opposite the end wall with the slot 108 to urge the block so that the plunger 90 carried thereby projects out of the housing 100 and into one of a series of recesses formed in the corresponding corner post 10 to support the mattress platform at that level with respect to the crib. Cylindrical structures 112 integral with the walls 102 defining the rounded corner of the housing receive screws for securing the latch mechanism 88 to the mattress support 86. One of these cylindrical structures 112 is near an end of the compression spring 96 and serves to contain it and to define a space limiting movement of a protuberance 114 on the inner end of the slidable block 94 that engages the end wall to limit the range of sliding block movement and protect the compression spring 96.

In manufacture, the drop-side crib is made as is the existing Community Playthings crib "WAS G10 Small Crib", except for the drop side 20. The drop side 20 replaces the front side of the existing crib, and the new crib can be packaged and shipped disassembled as the old crib was. Packaging and shipping involves making end panels with corner posts 10 rigidly attached and that bear plastic cups having embossed upper and lower leaves biased towards each other for forcibly receiving therebetween the free ends of the side panels upper and lower railings recessed to receive the leaf embossments for pivotal action. The end and side panels and mattress support are individually placed in one shipping carton, shipped, and then assembled by a shipped-to customer.

A customer on unpacking the carton, takes one end panel and inserts the set of railing free ends at one end of a side panel, in the plastic cups on the end panel Then either the other end panel is secured to the first side panel, or the second side panel is secured to the one end panel. Then the remaining end or side panel is attached to complete the borders of the crib and arrange them in rectangular fashion. The mattress support 86 is then mounted between the panels and secured at the desired height to the corner posts to complete the crib.

The new crib is assembled in much the same way. Because of the telescoping nature of the styles 24, the drop side will arrive at the customer's site with the upper portion 20 lowered on the lower portion 22. Thus it will be most convenient to mount the back side panel upon the end panels first. Then the drop-side upper-portion slides 38 would be slipped onto the lower ends of the latch brackets 36, and the lower railing 12 of the drop-side lower portion would then be fitted into its plastic cups on the end posts 10. The mattress support 86 would then be mounted.

In use, with a new baby, the mattress support 86 is normally installed in its highest position in the crib. Thus the plungers 90 of the latch mechanisms would normally be installed in the highest recesses in the respective corner posts 10, and from the front with the drop-side upper portion 20 lowered as would be the case perhaps with a newly assembled crib. The plungers 90 on the back edge of the mattress support 86 would be aligned with the top level recesses in the back corner posts 10 and pushed via the mattress support therein. The near edge of the mattress support 86 would then be lowered, the plungers 10 camming inward until aligned with the top level recesses whereupon they spring into the recesses under the biases of the springs 96.

After placement of a child in the crib, the upper portion 20 of the drop side would be raised as by centrally lifting the upper-portion railing 26 during which the telescoping stiles 24 elongate and the free ends 64 of the latch rods 56 slide up on the latch plate glides 84 and up and over the latch plate shoulders 60 to rest thereon and hold the upper railing 26 and hence the drop-side upper portion 20 in raised position when the mother releases the upper railing 26.

When it is time to remove the baby from the crib, the mother would grasp the drop-side upper railing 20 two triggers 58, as between her thumb and fore finger, to first raise the upper-portion 20 slightly and then squeeze them together to withdraw, against the bias of compression spring 80, the free ends 64 of the latch rods 56 from over the latch bracket shoulders 60 to allow the drop-side upper portion to descend, as by gravity, on the styles 24 to where their rods 32 engage in their tubes 28 the bottom surface of the railing 26.

It should be evident that the drop-side latch mechanisms 56 incorporate child-proof protection by requiring two serial motions for release. A child could not first lift latch mechanisms 56 by lifting the drop-side upper portion 20, and then squeeze the triggers 58 to remove the free ends 64 the latch mechanisms 56 from above the corner-post latch-bracket shoulders 60.

It should be noted that if the drop-side upper portion 20 has been raised for some reason during the interim of the baby's removal from the crib, that the mother readily could lower the drop-side upper portion 20 with her one free hand while holding the baby in the arm of the other hand. The mother would take her free hand to first lift latch mechanisms 56 by lifting the drop-side upper portion 20, and then squeeze the triggers 58 to remove the free ends 64 the latch mechanisms 56 from above the corner-post latch-bracket shoulders 60. Thereafter the upper portion 20 would drop by gravity with the stiles 24 telescoping together.

Raising the drop-side upper portion 20 fully, automatically resets the child-proof latch mechanisms 56 above the corner-post latch-bracket shoulders 60.

It should also be noted that even when the drop-side upper portion 20 is in the lowered or dropped position, access to the storage space beneath the crib is unimpeded.

When the crib is not to be used for a while, the crib can be collapsed onto itself, with or without the drop-side upper portion 20 being lowered. The pivotal mounting of the ends of railings of the panel sides in the corner post mounted plastic cups enables this. The free ends of the upper and lower railings 14 and 12 of the back side panel and the lower railing 12 of the drop-side lower portion 20 are mounted directly in the cups. The upper railing 26 of the drop-side upper portion 20 are pivotally mounted via depending lug 39 on slide 38. Collapse would be effected by folding the side panels to one side of an end panel, and the other end panel onto the side panels.

While there has been shown and described a preferred embodiment of the invention, it will be clear to others experienced in the art, that other and different applications may be made of the principles of the invention. It is therefore desired to be limited only by the scope or spirit of the appended claims.

What is claimed is:

1. A crib comprising two end panels, and sides interconnecting the end panels, one of said sides being a drop-side one having a lower portion fixed in position in normal use, and an upper portion adjustable with respect to the lower portion, wherein the upper portion is vertically translatable with respect to the rest of the crib, wherein the upper portion includes a drop-side upper railing and the lower portion includes a drop-side lower railing, and the railings are interconnected by the free ends of stiles having their other ends fixed to the respective railings, wherein the stiles are made of telescoping sections, wherein the telescoping stile sections are cylindrical, wherein stile sections are made of wood covered by a plastic tube, wherein the lower ones of the stile sections are the sections made of wood covered with a plastic tube, and the upper ones of the stile sections are plastic tubes having an interior diameter sufficient to receive slidably the lower plastic-covered-wood stile sections.

2. A crib comprising two end panels, and sides interconnecting the end panels, one of said sides being a drop-side one having a lower portion fixed in position in normal use, and an upper portion adjustable with respect to the lower portion, wherein the upper portion is vertically translatable with respect to the rest of the crib, wherein the end panels incorporate corner posts for supporting the crib and for bearing latch shoulders for supporting the drop-side upper portion in raised position and the upper portion includes a railing, and latch mechanisms carried by the upper-portion railing for interacting with the corner-post latch shoulders to support the drop-side upper portion in raised position, wherein the latch mechanisms incorporate latch rods biased outwardly of the ends of the drop-side upper-portion railing and whose free ends rest on the corner-post shoulders when the drop-side upper portion is in raised position.

3. A crib according to claim 2, wherein the drop-side upper railing is of an upper part having a groove slidably housing the latch rods and of a lover part closing off the groove and bearing two central slots and the latch rods at their inner ends are secured to triggers extending downwards through and below the lower part slots, and a compression spring is disposed between the two latch mechanisms to bias them outward.

4. A crib according to claim 3, wherein the latch rods biased outwardly by the compression spring that is strong enough to prevent latch mechanism operation by a child acting on the triggers but can be overcome by an adult acting on the triggers, are each of two interconnected pieces biased into an elongated relationship by a compression spring that is weaker than the compression spring biasing the latch rods outwardly in order to limit the pressure of the latch-rod free ends on the respective corner posts during up and down translation.

5. A crib according to claim 2, wherein the latch rods biased outwardly of the ends of the drop-side upper portion are each of two interconnected pieces biased into an elongated relationship by a bias weaker than the latch rod outward bias in order to limit the pressure of the latch-rod free ends on the respective corner posts during up and down translation.

6. A crib according to claim 2, wherein the drop-side upper railing is of an upper part having a groove slidably housing the latch rods and of a lower part closing off the underside of the groove and the latch-rod free ends are wider than most of the groove, and mechanisms for withdrawing the latch rods interiorly of the groove, a lower portion of the groove being wider at the groove's outer ends to accommodate inward movement of the wider free ends for unlatching the drop-side upper portion.

7. A crib according to claim 6, wherein an upper portion of the groove above the wider lower portion is not wider and does not accommodate inward movement of the wider free ends for unlatching the drop-side upper portion.

8. A crib according to claim 6, wherein a part of the upper portion of the groove above and contiguous with the wider lower portion is wider too to receive the inner ends of the wider latch-bar free ends when resting on the corner-post shoulders under the weight of the drop-side upper portion but does not accommodate inward movement of the wider free ends for unlatching the drop-side upper portion.

9. A crib according to according to claim 8, wherein the wide latch-bar free ends are downwardly biased to a normal position in the wider lower portion of the groove.

10. A crib comprising two end panels, and sides interconnecting the end panels, one of said sides being a drop-side one having a lower portion fixed in position in normal use, and an upper portion adjustable with respect to the lower portion, wherein the upper portion is vertically translatable with respect to the rest of the crib, wherein the drop-side upper portion includes an upper railing pivotally mounted at its ends on the associated corner posts throughout its range of vertical movement by latch brackets mounted on opposing faces of the corner posts and bearing vertical guides, and slides pivotally mounted on each end of railing and slidably embracing the latch bracket guides for vertical movement.

11. A crib according to claim 10, wherein the latch brackets are also bearing shoulders for supporting the drop-side upper portion in raised position, and latch mechanisms are carried by the upper-portion railing for interacting with the corner-post latch-bracket shoulders to support the drop-side upper portion in raised position.

12. A crib comprising two end panels, and sides interconnecting the end panels, one of said sides being a drop-side one having a lower portion fixed in position in normal use, and an upper portion adjustable with respect to the lower portion, wherein the end panels incorporate corner posts for supporting the crib, and a rectangular mattress support latchable on the corner posts at various levels within the crib, the mattress support being latched on the corner posts by latch mechanisms mounted underneath its fours corners and operated by a tool inserted through slots in the support.

13. A crib according to claim 12, wherein a latch mechanism comprises a housing open on its upper side, a block slidable within the housing and carrying a plunger extending thereout to be received within recesses in a corner post, a spring biasing the block to plunger-extending position, and a slot in the block for engagement by a tool inserted through the associated mattress-support slot for withdrawing the plunger from a corner-post recess.

* * * * *